US008444035B2

(12) United States Patent
Coleman, Jr.

(10) Patent No.: US 8,444,035 B2
(45) Date of Patent: May 21, 2013

(54) PNEUMATIC STAPLE OR NAIL GUN WITH DUAL TRIGGER MECHANISM

(75) Inventor: Jerry D. Coleman, Jr., Wilmington, NC (US)

(73) Assignee: Q.E.P. Co., Inc., Boca Raton, FL (US)

( * ) Notice: Subject to any disclaimer, the term of this patent is extended or adjusted under 35 U.S.C. 154(b) by 113 days.

(21) Appl. No.: 12/806,651

(22) Filed: Aug. 18, 2010

(65) Prior Publication Data

US 2012/0043364 A1 Feb. 23, 2012

(51) Int. Cl.
*B27F 7/09* (2006.01)

(52) U.S. Cl.
USPC ..... 227/8; 227/130; 173/169

(58) Field of Classification Search
USPC ..... 227/8, 120, 130, 147; 173/169
See application file for complete search history.

(56) References Cited

U.S. PATENT DOCUMENTS

| | | | | |
|---|---|---|---|---|
| 3,695,309 | A * | 10/1972 | Finn | 140/124 |
| 3,741,313 | A * | 6/1973 | States | 173/176 |
| 3,893,610 | A * | 7/1975 | Smith | 227/8 |
| 4,688,710 | A * | 8/1987 | Massari et al. | 227/109 |
| 7,237,707 | B1 * | 7/2007 | Wakelin et al. | 227/147 |
| 2003/0168491 | A1 * | 9/2003 | Goodwin | 227/147 |

* cited by examiner

*Primary Examiner* — M. Alexandra Elve
*Assistant Examiner* — Nathaniel Chukwurah
(74) *Attorney, Agent, or Firm* — Christie, Parker & Hale, LLP

(57) ABSTRACT

An improved apparatus for nailing or stapling flooring pneumatically, wherein a pneumatic stapler or nailer is provided with a dual trigger single sequential actuation system by which an operator can reach either trigger with his index finger. In one embodiment, the triggers being interconnected. In a second embodiment, each trigger actuates a valve that communicates with a pneumatic piston which drives the staple.

7 Claims, 6 Drawing Sheets

PNEUMATIC STAPLE OR NAIL GUN WITH DUAL TRIGGER MECHANISM

CROSS REFERENCE TO RELATED APPLICATION

This application claims the benefit of U.S. Provisional Application No. 61/274,341, filed Aug. 18, 2009.

FIELD OF THE INVENTION

The present invention relates to an apparatus for installing tongue and groove, wood or engineered flooring, and particularly to pneumatic staple or nail gun apparatus, hereinafter "stapler", for quick and accurate stapling or nailing of flooring members into place. The apparatus includes primary and secondary triggers which perform the same function, but allow ready access to a trigger regardless of the orientation of the stapler with regard to the user.

BACKGROUND OF THE INVENTION

During the installation of flooring, it is often necessary for a pneumatic staple gun operator to assume a position from which it is extremely difficult to reach the actuating trigger easily or comfortably by an index finger, the normal trigger finger, or to use the staple gun in an orientation where it is difficult to reach the trigger to activate the stapler. No known device addresses this problem. Heretofore, there has been no suitable device that will allow ease of actuation when the stapler is operated in an inverted position.

SUMMARY OF THE INVENTION

The invention provides apparatus which incorporates a dual trigger single sequential actuation system in a pneumatic staple or nail gun. The invented device, known as a Twin Trigger pneumatic stapler, has a first trigger in the normal position for actuation of the stapler, and a secondary trigger interconnected to the first trigger, whereby actuation of the secondary trigger will actuate the stapler through the first trigger. The two triggers can be interconnected by a flexible cable, or they can be connected pneumatically to one or more actuating valves. The invented tool also includes a sequential safety trip apparatus.

Ordinarily, when a stapler is utilized in a direction which places the trigger in a position where it must be activated by the weakest finger on the operator's hand, it is difficult to operate easily and over long periods of time. The invented Twin Trigger stapler places a trigger in reach of an operator's index finger regardless of the position in which the stapler is operated.

The present invention is particularly useful for installing solid and laminate flooring, as well as tongue and groove flooring.

OBJECTS OF THE INVENTION

The principal object of the present invention is to provide an improved pneumatic stapler apparatus that can be easily operated in any orientation.

Another object of the invention is to provide apparatus for stapling flooring which reduces fatigue of the operator.

It is also an object of the invention to provide improved ergonomics in a pneumatic stapler apparatus.

It is another objection of the invention to provide improved stapler apparatus that can readily be actuated when the operator is positioned either in front of or behind the stapler tool.

It is another object of the invention to provide a pneumatic stapler apparatus that enables the user to always have his trigger finger in the most comfortable position for trigger activation.

It is also an object of the invention to provide a dual-trigger pneumatic stapler tool with a sequential safety trip apparatus.

BRIEF DESCRIPTION OF THE DRAWINGS

The foregoing and other objects will become more readily apparent by referring to the following detailed description and the appended drawings in which.

DETAILED DESCRIPTION

Figure 1:
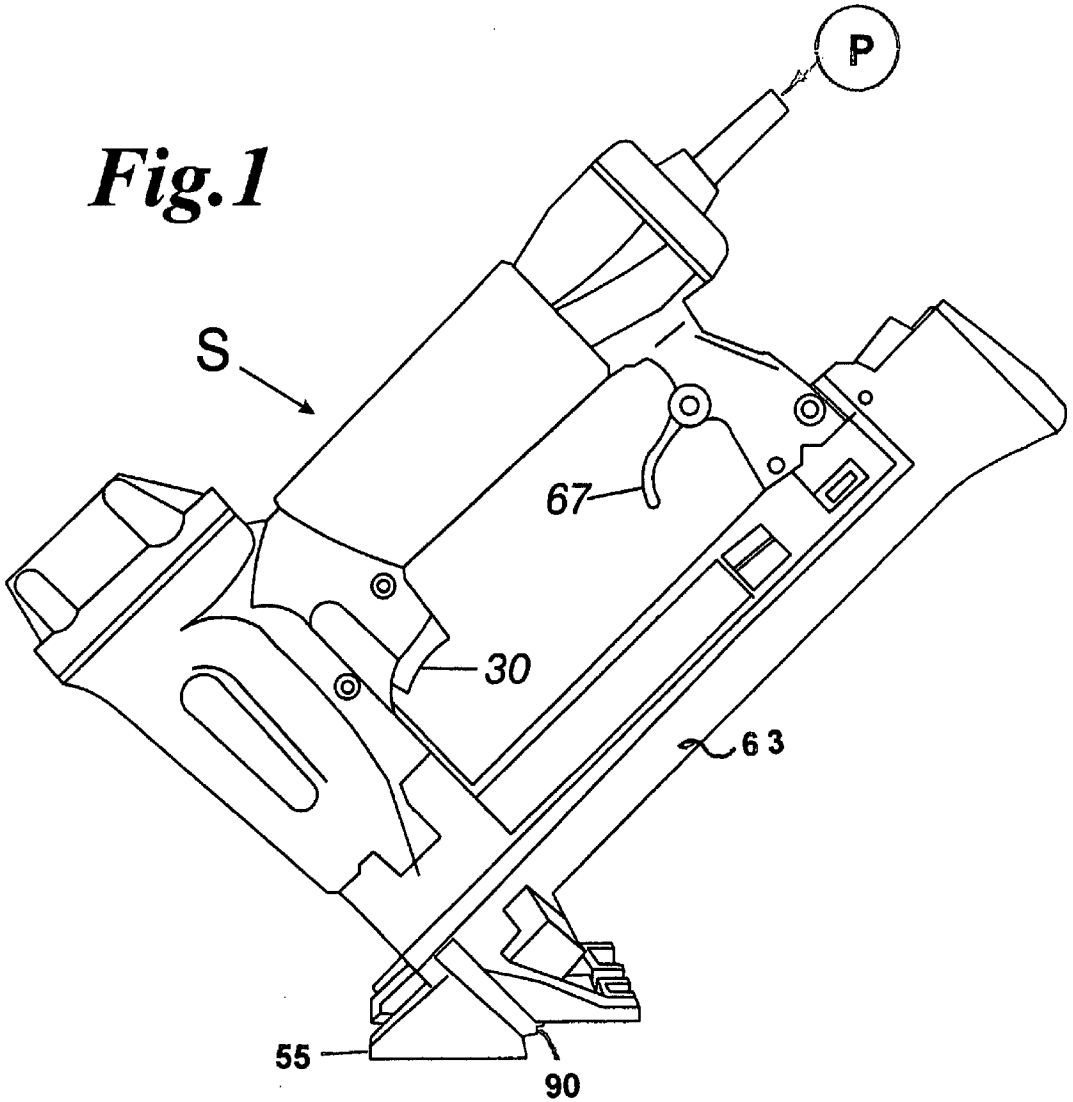
FIG. 1 is a side view of the invented Twin Trigger stapler.
Figure 2:
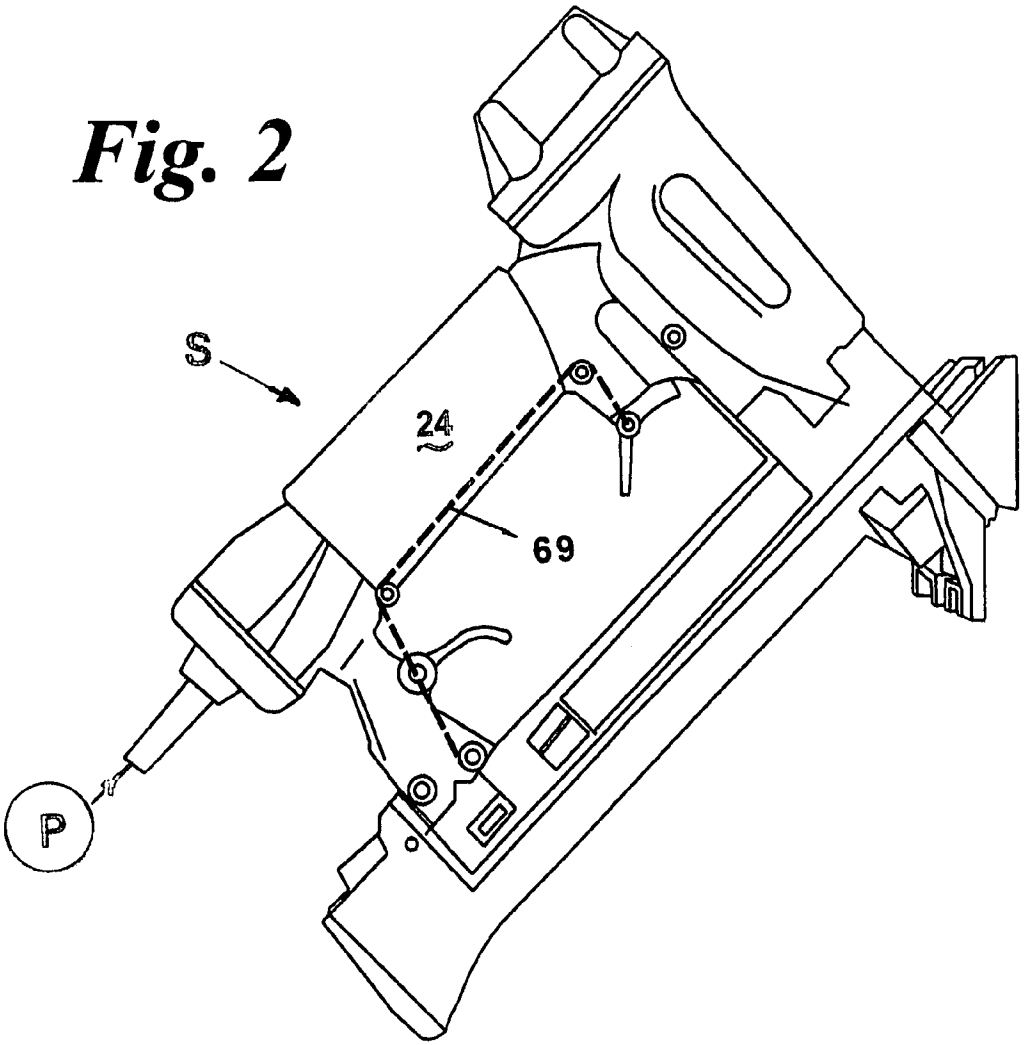
FIG. 2 is a longitudinal cross sectional view of the invented Twin Trigger stapler showing one embodiment thereof.

Referring now to the drawings, and particularly to FIG. 1, the invented stapler device S includes a primary actuating trigger 30 in the normal position for similar pneumatic staple guns. A flexible monofilament cable 16 (in FIG. 2 and FIG. 6) is attached to the primary trigger through trigger plate 32. The cable is positioned in a slot in trigger cable cap 68 (see FIG. 6). The cable may pass through a channel that is cast into the handle 24 of the stapler S. The opposite end of the cable is attached to a secondary trigger 67. A series of pulleys or guide rolls 35, 39 are provided as shown to guide the movement of the cable and prevent it from binding.

The body of the stapler, including the handle is preferably cast aluminum, and may be provided with a slot which mates with cable cap 68 to provide a channel in which the cable 69 can operate, and by which it is protected.

The secondary trigger 67 is mounted as shown in FIGS. 1 through 4 and 6.

Figure 3:
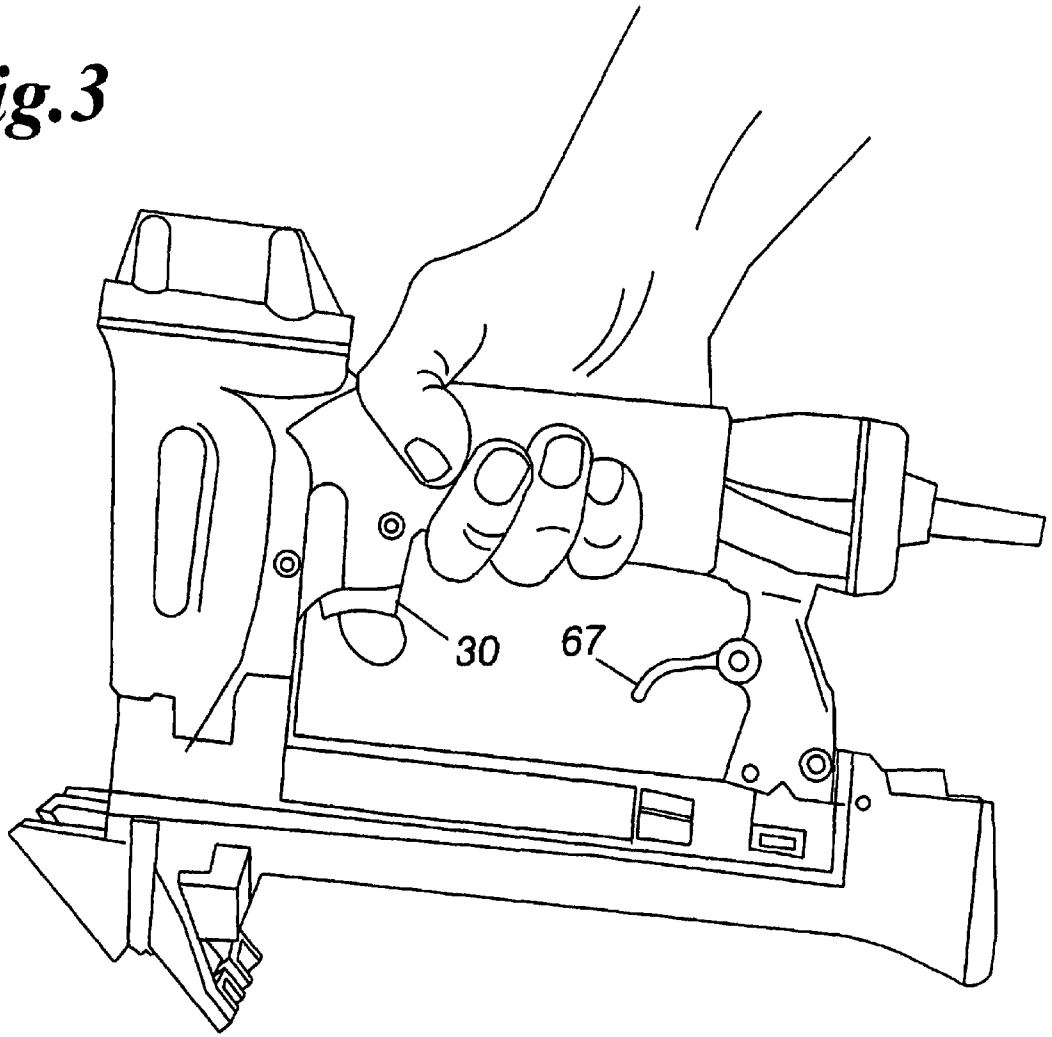
FIG. 3 is a side view of the invented Twin Trigger Stapler with an operator's index finger operating the normal actuating trigger.
Figure 4:
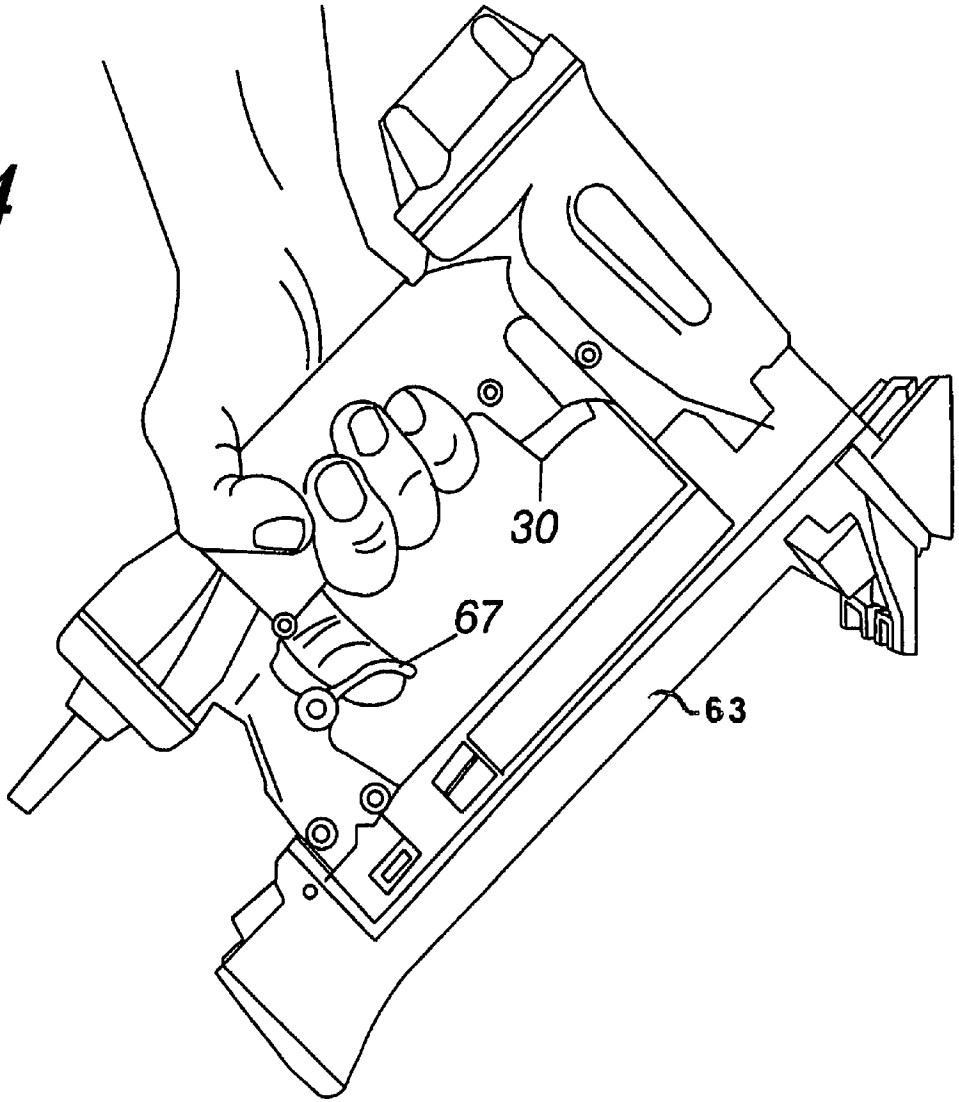
FIG. 4 is a side view of the invented Twin Trigger stapler with an operator's index finger operating the secondary trigger.

The secondary trigger 67 is utilized as shown in FIG. 3 when the staple gun S is in the reverse position or in any position with the primary trigger 30 near the heel of the operator's hand. Because of the cable 69 connection, actuation of the secondary trigger 67 will actuate the stapler through the first trigger 30. The installer is positioned in front of the flooring with the stapler in stapling position. The secondary trigger enables the installer to activate the gun using his index or trigger finger. This puts the installer in a comfortable and precise stapling position. If the installer prefers to position himself behind the tool then the conventional trigger is used for optimum precision and comfort.

A compressed air power source P is provided for operation of the stapler, which is pressure-regulated.

During normal operation, a contact safety in the nose of the stapler is depressed by contacting it to the workpiece. This causes movement of the trigger plates 32, allowing the triggers to be pulled, and either of the two triggers are pulled to actuate the stapler, which causes a staple to be stripped from the magazine 63 and be driven into and through the workpiece. A trigger is pulled once for each subsequent actuation.

Figure 5:
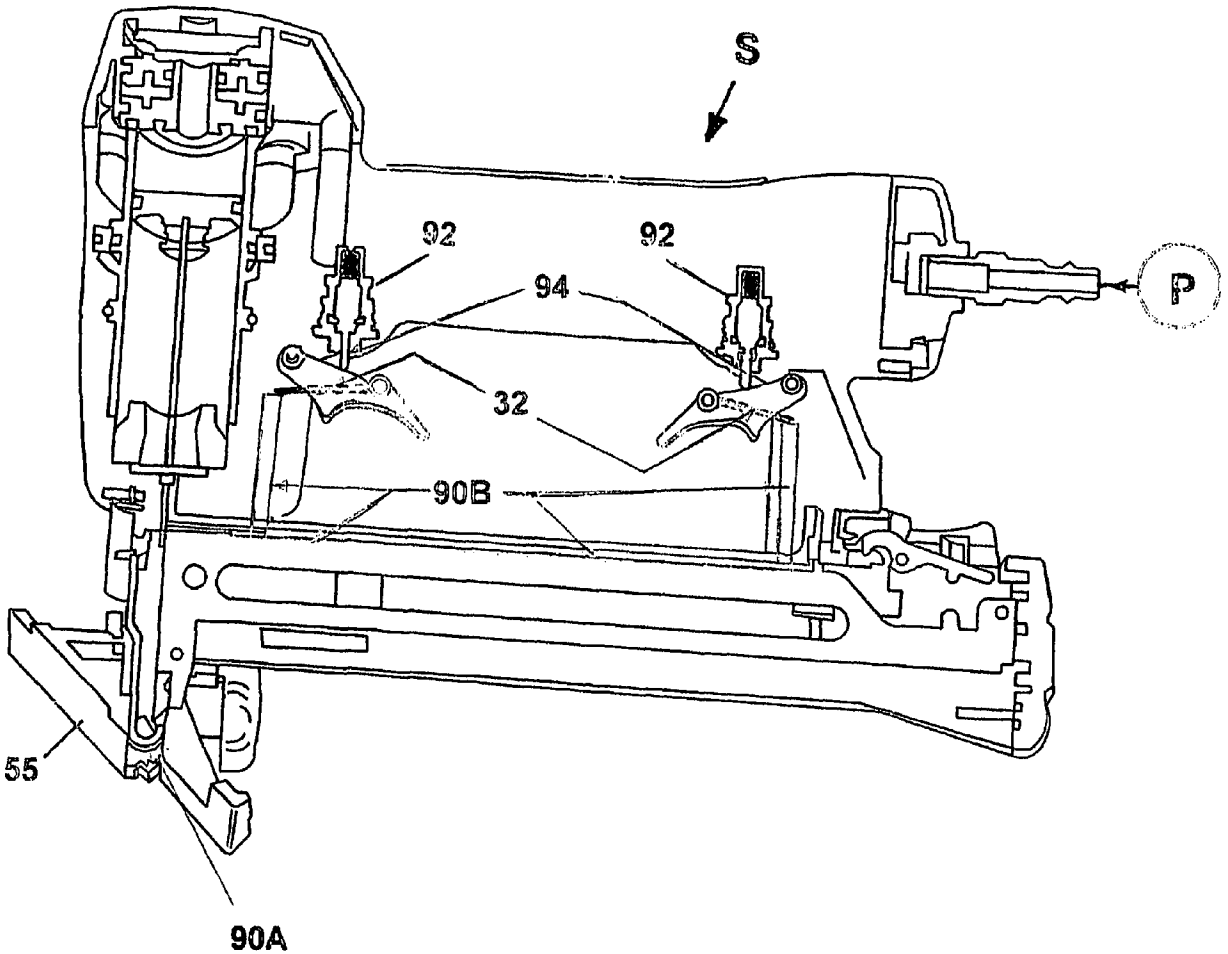
FIG. 5 is a longitudinal cut-away view of an alternative Twin Trigger Stapler apparatus utilizing actuating valves.

As shown in alternative embodiment of FIG. 5, the tool incorporates a sequential trip contact safety in which a safety arm 90 extends from the front guide 55 terminating at trigger plate 32 associated with each trigger 30, 67. The sequential trip system requires the operator to hold the front guide of the tool against the work surface before pulling the trigger. The safety arm 90 A of the tool must be depressed by placing the tool against the work surface or flooring. Depressing the safety arm 90A pushes safety arm 90B upward against both trigger plates 32. This places both trigger plates 32 in the "up" position so that when the associated trigger is pulled, contact is made with the valve stem 94 of valve 92 to open the valve to the pneumatic chamber to actuate the tool a single time. The secondary trigger operates in the same manner. The operator can select either trigger to actuate the pneumatic staple gun, as desired. This alternative device does not use a cable. The safety arms 90A and 90B are preferably made of aluminum.

In a typical flooring application, the installer is positioned in front of the flooring with the stapler in stapling position. The secondary trigger enables the installer to activate the gun using his index of trigger finger. This puts the installer in a comfortable and precise stapling position. If the installer prefers to position behind the tool then the primary trigger is used for optimum precision and comfort.

Figure 6:
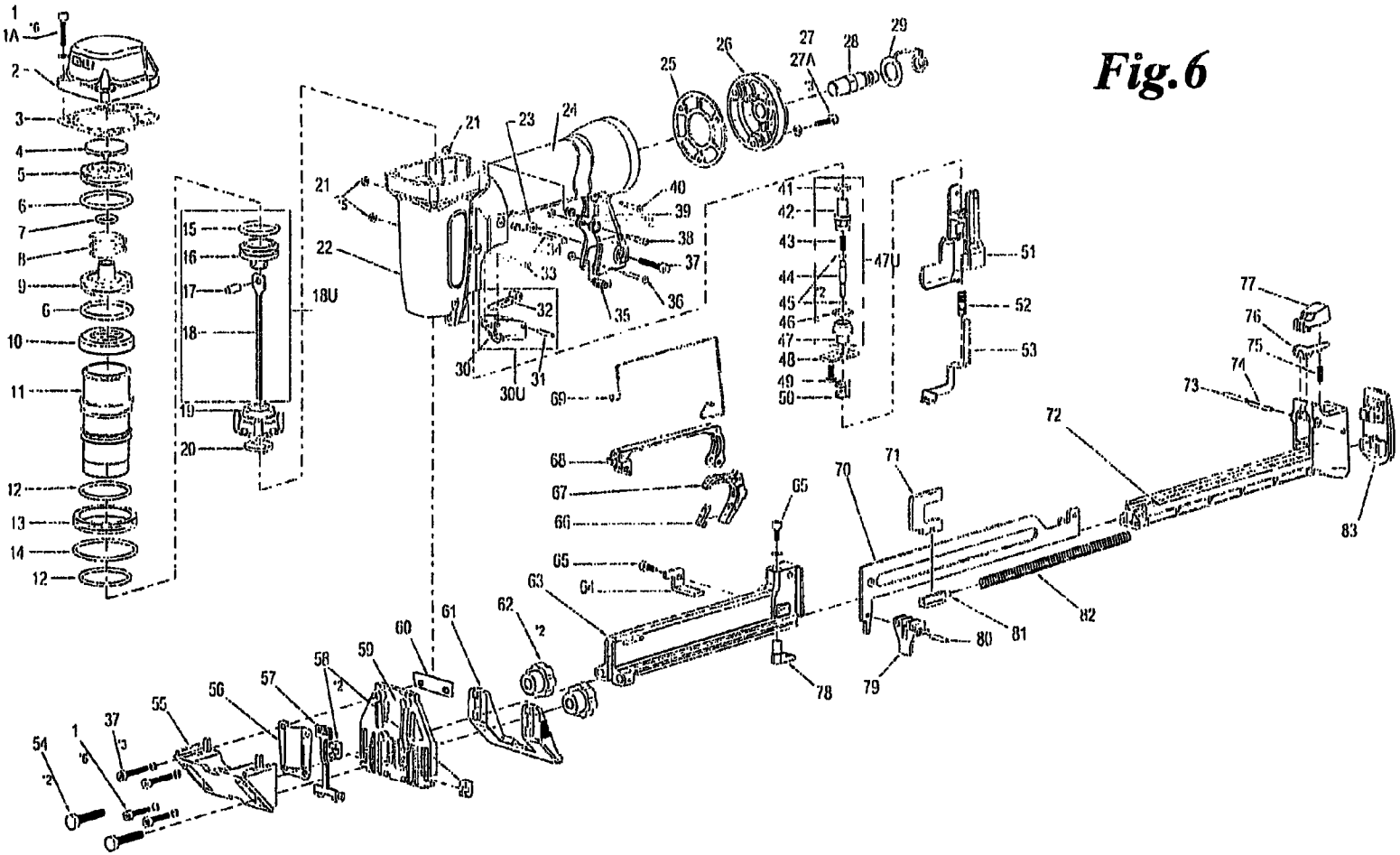
FIG. 6 is an exploded view of the Twin Trigger Stapler embodiment of FIG. 1.

For the purpose of completeness, the following reference number list refers to all items in FIG. 6.

| | |
|---|---|
| 1 | screw |
| 2 | cap |
| 3 | gasket, cap |
| 4 | top seal |
| 5 | poppet |
| 6 | o-ring |
| 7 | o-ring |
| 8 | head valve spring |
| 9 | head valve |
| 10 | cylinder top seal |
| 11 | cylinder |
| 12 | o-ring |
| 13 | cylinder ring |
| 14 | o-ring |
| 15 | o-ring |
| 16 | piston |
| 17 | pin |
| 18 | driver blade |
| 18U | piston/driver blade assembly |
| 19 | bumper |
| 20 | guide driver |
| 21 | pin retainer |
| 22 | body |
| 23 | nut |
| 24 | grip |
| 25 | handle gasket |
| 26 | handle cap |
| 27 | screw |
| 28 | air plug |
| 29 | plug cap |
| 30 | primary trigger |
| 31 | spring pin |
| 32 | trigger plate |
| 33 | trigger pin |
| 34 | pin |
| 35 | roller |
| 36 | o-ring |
| 37 | screw |
| 38 | pin |
| 39 | roller |
| 40 | pin |
| 41 | o-ring |

-continued

| | |
|---|---|
| 42 | trigger valve plunger |
| 43 | trigger valve spring |
| 44 | trigger valve stem |
| 45 | o-ring |
| 46 | o-ring |
| 47 | trigger valve housing |
| 47U | trigger valve unit |
| 48 | hold plate |
| 49 | screw |
| 50 | spring |
| 51 | arm guide |
| 52 | spring |
| 53 | safety arm |
| 54 | screw |
| 55 | front guide |
| 56 | arm cover |
| 57 | safety arm |
| 58 | nose insert |
| 59 | nose |
| 60 | driver plate |
| 61 | foot |
| 62 | knob |
| 63 | magazine |
| 64 | stop plate |
| 65 | screw |
| 66 | plate |
| 67 | secondary trigger |
| 68 | trigger cable cap |
| 69 | trigger cable |
| 70 | magazine core |
| 71 | pusher |
| 72 | magazine, slide |
| 73 | spring pin |
| 74 | spring pin |
| 75 | latch |
| 76 | latch |
| 77 | latch cover |
| 78 | latch stop |
| 79 | core tip |
| 80 | spring |
| 81 | shuttle, pusher |
| 82 | pusher spring |
| 83 | magazine bumper |
| 84 | washer |

SUMMARY OF THE ACHIEVEMENT OF THE OBJECTS OF THE INVENTION

From the foregoing, it is readily apparent that I have invented an improved pneumatic stapler apparatus for high speed, high volume installation of wooden flooring, particularly where it is necessary to orient the stapler apparatus in a position where it would be difficult or uncomfortable to activate it by reaching the trigger, by providing a multiple trigger on the stapler in at least two locations, one of which is easy to reach with a trigger finger regardless of orientation of the apparatus at the time, and by providing an improved pneumatic stapler apparatus that can be easily operated in any orientation, that can readily be actuated when the operator is positioned either in front of or behind the stapler apparatus, that enables the user to always have his trigger finger in the most comfortable position for trigger activation. the use of which reduces fatigue of the operator, and provides improved ergonomics.

It is to be understood that the foregoing description and specific embodiments are merely illustrative of the best mode of the invention and the principles thereof, and that various modifications and additions may be made to the apparatus by those skilled in the art, without departing from the spirit and scope of this invention.

What is claimed is:

1. A pneumatic tool for stapling floor elements, having a handle, a staple driver, an actuating trigger positioned in said handle, and a secondary trigger positioned in said handle spaced from said actuating trigger, a pair of actuating valves connected to a pneumatic cylinder for actuation thereof, said actuating trigger being connected to a first of said pair of valves, and said secondary trigger being connected to a second of said pair of valves, whereupon pressing of either trigger actuates the valve, and initiates operation of the tool, the tool further comprising a sequential trip system having a safety arm connected to an associated trigger plate of each of said triggers and extending from said trigger plates to said tool adjacent said staple driver, wherein pressing said safety arm against a work surface allows actuation of either trigger.

2. A tool for stapling floor elements, having a handle, a staple driver, an actuating trigger positioned in said handle, and a secondary trigger spaced from said actuating trigger, said actuating trigger being connected to said secondary trigger by a flexible cable, the cable passing through the handle of the tool, said cable passing over and being guided by a series of pulleys, whereupon pressing of either trigger actuates the actuating trigger and the staple driver, the tool further comprising a sequential trip system having a safety arm for exerting a force on an associated trigger plate of each of said triggers and extending from said trigger plates to said tool adjacent said staple driver, wherein pressing said safety arm against a work surface allows actuation of either trigger.

3. A tool according to claim 1 wherein said handle is provided with a slot or channel and said cable is positioned in said channel.

4. A tool according to claim 1 wherein said cable is a flexible monofilament.

5. A tool for stapling floor elements, having a handle, a staple driver, an actuating trigger positioned in said handle, and a secondary trigger spaced from said actuating trigger, said triggers connected pneumatically to one or more actuating valves whereupon pressing of either trigger actuates the actuating trigger and the staple driver, the tool further comprising a sequential trip system having a safety arm for exerting a force on an associated trigger plate of each of said triggers and extending from said trigger plates to said tool adjacent said staple driver, wherein pressing said safety arm against a work surface allows actuation of either trigger.

6. A tool according to claim 5 wherein said handle is provided with a slot or channel and a cable is positioned in said channel.

7. A tool according to claim 6 wherein said cable is a flexible monofilament.

* * * * *